US007165531B2

(12) United States Patent
Bratvold et al.

(10) Patent No.: US 7,165,531 B2
(45) Date of Patent: Jan. 23, 2007

(54) NEGATIVE RATE SHAPING TORQUE CAPSULE

(75) Inventors: Brian Hans Bratvold, New Hartford, IA (US); Gary Mark Frodsham, Cedar Falls, IA (US); David William Peters, Cedar Falls, IA (US)

(73) Assignee: Deere & Company, Moline, IL (US)

( * ) Notice: Subject to any disclaimer, the term of this patent is extended or adjusted under 35 U.S.C. 154(b) by 36 days.

(21) Appl. No.: 11/058,149

(22) Filed: Feb. 15, 2005

(65) Prior Publication Data

US 2006/0180123 A1 Aug. 17, 2006

(51) Int. Cl.
*F02D 31/00* (2006.01)
*F02D 33/00* (2006.01)

(52) U.S. Cl. ..... 123/372; 123/365

(58) Field of Classification Search ..... 123/372, 123/501, 41 R, 373, 374, 375, 365
See application file for complete search history.

(56) References Cited

U.S. PATENT DOCUMENTS

| | | | | |
|---|---|---|---|---|
| 4,606,313 | A * | 8/1986 | Izumi et al. | 123/386 |
| 4,616,616 | A * | 10/1986 | Staniak et al. | 123/357 |
| 4,754,734 | A * | 7/1988 | Ohkoshi | 123/366 |
| 5,325,831 | A * | 7/1994 | Handa | 123/373 |
| 5,613,474 | A * | 3/1997 | Nakamura et al. | 123/496 |
| 2004/0136850 | A1 * | 7/2004 | Klopfer et al. | 417/500 |

* cited by examiner

*Primary Examiner*—Mahmoud Gimie

(57) ABSTRACT

A negative rate shaping torque capsule is provided that effectively reduces torque rise of the engine. The device is part of the mechanical governor and allows fuel control rack position to decrease as engine speed decreases, thus reducing the amount of fuel delivered and reducing torque rise. The device works by the addition of a pivot arm to the existing main governor arm. One end of the pivot arm is pinned to the governor arm, and a roller is pinned to the opposite end. This roller bears on the fuel rack, maintaining rack position. An additional roller is pinned to the side of the pivot arm and bears on the tension arm. The travel of the pivot arm relative to the governor arm is limited in one direction by a physical stop, and in the other direction by a torque capsule (TC) spring. The TC spring is fixed to the governor arm and bears on the pivot arm roller opposite the tension arm. The TC spring holds the pivot arm roller against the tension arm. As engine speed increases the increased flyweight force causes an increase in the force of the pivot arm roller against the tension arm. At some point this force overcomes the preload on the TC spring causing the pivot arm to lift off its physical stop effectively causing the governor arm to bend at the joint where the pivot arm is pinned to the governor arm, in turn causing the rack roller end of the pivot arm to move in a direction of increasing rack travel. As engine speed continues to increase the rack roller continues to increase rack travel until the flyweight force overcomes the main governor spring and rack travel begins to decrease as the engine follows the governor droop curve up to the high idle speed.

11 Claims, 7 Drawing Sheets

Rack Position versus Engine Speed
Standard Governor

Rack Position versus Engine Speed

NEGATIVE RATE SHAPING TORQUE CAPSULE

FIELD OF THE INVENTION

The present invention relates generally to internal combustion engines. More particularly, the present invention relates to fuel systems for internal combustion engines. Specifically, the present invention relates to mechanical governors for compression ignition engines.

BACKGROUND OF THE INVENTION

One major advantage of known mechanical governors are their simplicity and low cost of production. However, use of mechanical governors reduces the fuel system's flexibility. One problem is the relatively high fuel backup characteristic of some fuel injection systems. High fuel backup causes increased full load fuel delivery as the engine's speed is decreased from rated speed. While some fuel backup is desirable for torque rise, excessive backup causes high torque rise, smoke and exhaust emissions. Space constraints also limit governor design flexibility because of existing design envelopes. Some mechanical governor designs include means for increasing the fuel control rack travel as speed decreases. This effectively increases fuel backup in addition to the natural characteristic of the fuel injection system. This mechanism is known as a "torque capsule", and is used to tailor the torque rise of an engine to a specified amount. However, the limitations of known "torque capsule" and governor designs is that they can only be used to increase torque rise, but not to decrease it, as is needed at some engine ratings.

Accordingly, there is a clear need in the art for an improved mechanical governor design embodying a "torque capsule" that will allow for both an increase and a decrease in torque rise depending on the needs of the engine and fit within existing design envelopes.

SUMMARY OF THE INVENTION

In view of the foregoing, it is an object of the invention to provide an improved mechanical governor design embodying a "torque capsule".

Another object of the invention is the provision of such a governor that will allow for both an increase and a decrease in torque rise depending on the needs of the engine.

A further object of the invention is to provide such a governor that will fit within existing design envelopes.

An additional object of the invention is the provision of such a governor that is readily and inexpensively manufactured using known techniques and materials.

A still further object of the invention is to provide such a governor that utilizes a few number of parts, is durable, and easy to maintain.

The foregoing and other objects of the invention together with the advantages thereof over the known art which will become apparent from the detailed specification which follows are attained by a governor for an internal combustion engine, the governor being operative to translate a fuel control rack of the engine in response to centrifugally actuated flyweight movement in response to engine speed, the governor comprising: a governor arm body; a pivot arm pivotally mounted to the governor arm body; a tension arm attached to the governor arm body adjacent to the tension arm roller; and, a torque capsule (TC) spring interposed between the tension arm and the governor arm body so that the pivot arm can pivot relative to the governor arm body; wherein the TC spring holds the pivot arm against the tension arm and as engine speed increases, a flyweight force causes an increase in the force of the pivot arm against the tension arm, as speed increases further, the flyweight force overcomes a preload of the TC spring causing the pivot arm to pivot at a joint where the pivot arm is mounted to the governor arm body, in turn causing an end of the pivot arm to move in a direction of increasing rack travel and as engine speed continues to increase, the pivot arm continues to increase rack travel until the flyweight force overcomes a main governor spring, so that rack position is allowed to increase with increased engine speed, and decrease with decreased engine speed, thereby reducing the amount of fuel backup and preventing excess torque rise and reducing smoke and exhaust emissions.

Other objects of the invention are attained by a governor arm assembly comprising: a governor arm body; a bearing member pivotally mounted to the governor arm body; a pivot arm pivotally mounted to the governor arm body; a tension arm roller mounted to the pivot arm; a rack roller mounted to the pivot arm; a tension arm attached to the governor arm body adjacent to the tension arm roller; and, a torque capsule (TC) spring interposed between the tension arm and the main arm.

Still other objects of the invention are attained by a governor for a compression ignition engine, the engine having a fuel system wherein individual fuel pumping elements, connected with injection nozzles, are actuated by cam followers engaging an engine driven cam shaft and the amount of fuel delivered by each pumping element is regulated by control sleeves operatively linked to a control rack, the governor is centrifugally actuated based upon the speed of an engine driven gear and controls the translation of the control rack and, in turn, the amount of fuel delivered by each pumping element, the governor comprising: a governor arm body having a central shaft bore, a pair of bearing arms and a main arm, the main arm having a mounting structure; a bearing member pivotally mounted between the bearing arms; a pivot arm having a first end and a second end, the first end being disposed in the mounting structure and pivotally journaled there, a portion of the mounting structure serving as a physical stop for the pivot arm; a tension arm roller mounted to the pivot arm; a rack roller mounted to the second end of the pivot arm; a tension arm attached to the main arm adjacent to the tension arm roller; and, a torque capsule (TC) spring interposed between the tension arm and the main arm so that the pivot arm can pivot relative to the main arm, but its motion is limited in a first direction by the physical stop, and in a second direction by the TC spring; wherein the TC spring holds the tension arm roller against the tension arm and in a static condition holds the pivot arm against the physical stop, as engine speed increases increased flyweight force causes an increase in the force of the tension arm roller against the tension arm, as speed increases further the flyweight force overcomes a preload of the TC spring causing the pivot arm to lift off its physical stop, in turn causing the governor arm assembly to bend at a joint where the pivot arm is mounted to the main arm, in turn causing the rack roller end of the pivot arm to move in a direction of increasing rack travel and as engine speed continues to increase, the rack roller continues to increase rack travel until the flyweight force overcomes a main governor spring, so that rack position is allowed to increase with increased engine speed, and decrease with decreased engine speed, thereby reducing the amount of fuel backup and preventing excess torque rise and reducing smoke and exhaust emissions.

A negative rate shaping torque capsule is provided that effectively reduces torque rise of the engine. The device is part of the mechanical governor and allows fuel control rack position to decrease as engine speed decreases, thus reducing the amount of fuel delivered and reducing torque rise. The device is simple, low cost, and compact requiring no additional space for packaging the governor.

The device works by the addition of a pivot arm to the existing main governor arm. One end of the pivot arm is pinned to the governor arm, and a roller is pinned to the opposite end. This roller is referred as the rack roller and bears on the fuel rack, maintaining rack position. An additional roller, the tension arm roller, is pinned to the side of the pivot arm and bears on the tension arm. The travel of the pivot arm relative to the governor arm is limited in one direction by a physical stop, and in the other direction by a torque capsule (TC) spring. The TC spring is fixed to the governor arm and bears on the pivot arm roller opposite the tension arm. The TC spring holds the pivot arm roller against the tension arm. In a static condition the TC spring also holds the pivot arm against its physical stop on the governor arm. As engine speed increases the increased flyweight force causes an increase in the force of the pivot arm roller against the tension arm. At some point this force overcomes the preload on the TC spring causing the pivot arm to lift off its physical stop. This effectively causes the governor arm to bend at the joint where the pivot arm is pinned to the governor arm, in turn causing the rack roller end of the pivot arm to move in a direction of increasing rack travel. As engine speed continues to increase the rack roller continues to increase rack travel until the flyweight force overcomes the main governor spring and rack travel begins to decrease as the engine follows the governor droop curve up to the high idle speed.

The benefit of the invention is that existing low cost fuel systems can be used on ratings that were previously impossible to achieve within the constraints of torque rise, smoke and emission limits. The device is simple, compact, and inexpensive.

To acquaint persons skilled in the art most closely related to the present invention, one preferred embodiment of the invention that illustrates the best mode now contemplated for putting the invention into practice is described herein by and with reference to, the annexed drawings that form a part of the specification. The exemplary embodiment is described in detail without attempting to show all of the various forms and modifications in which the invention might be embodied. As such, the embodiment shown and described herein is illustrative, and as will become apparent to those skilled in the art, can be modified in numerous ways within the spirit and scope of the invention—the invention being measured by the appended claims and not by the details of the specification.

BRIEF DESCRIPTION OF THE DRAWINGS

For a complete understanding of the objects, techniques, and structure of the invention reference should be made to the following detailed description and accompanying drawings, wherein.

DESCRIPTION OF THE PREFERRED EMBODIMENT

Figure 1:
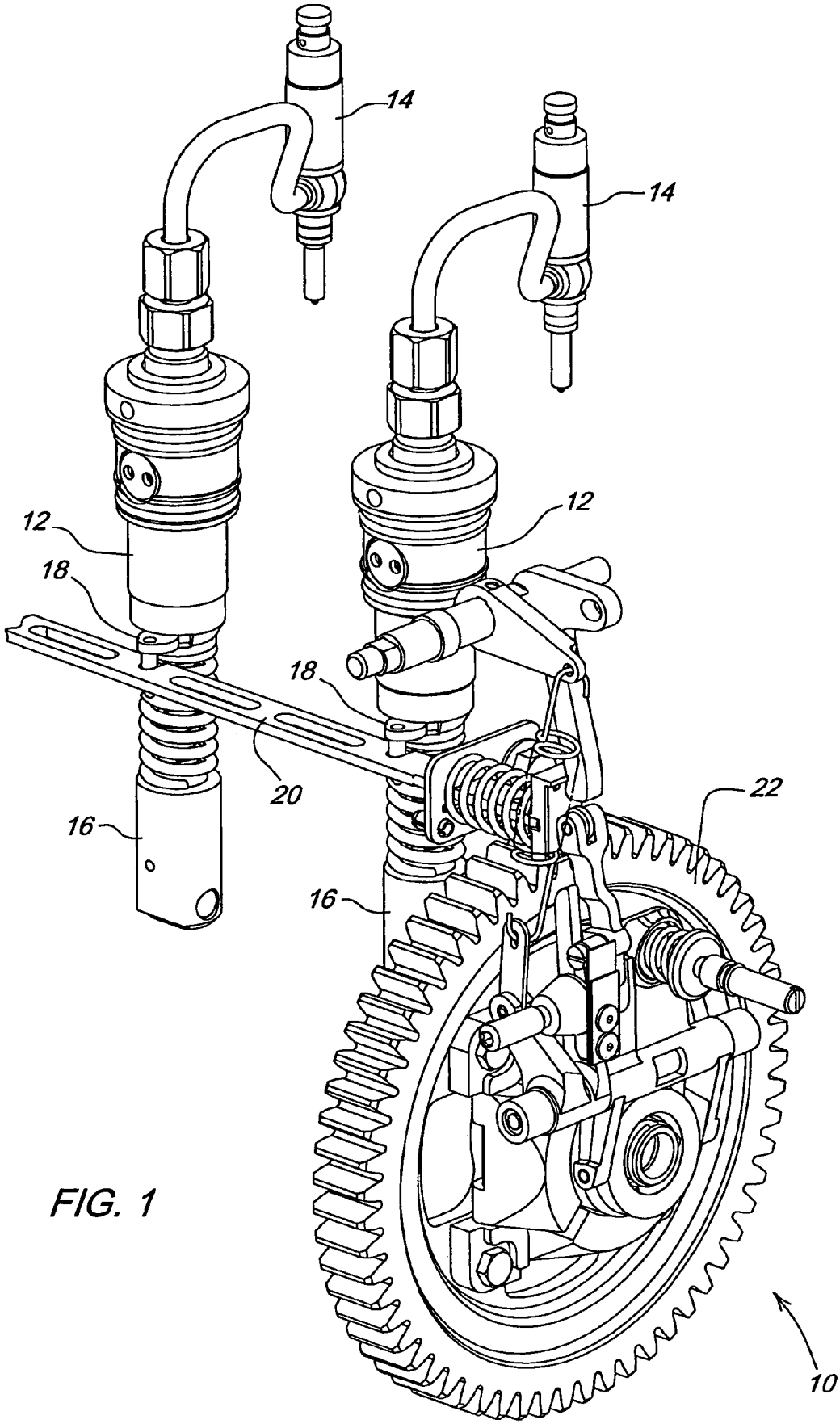
FIG. 1 is a perspective view of a portion of a fuel system for a compression ignition engine.
Figure 2:
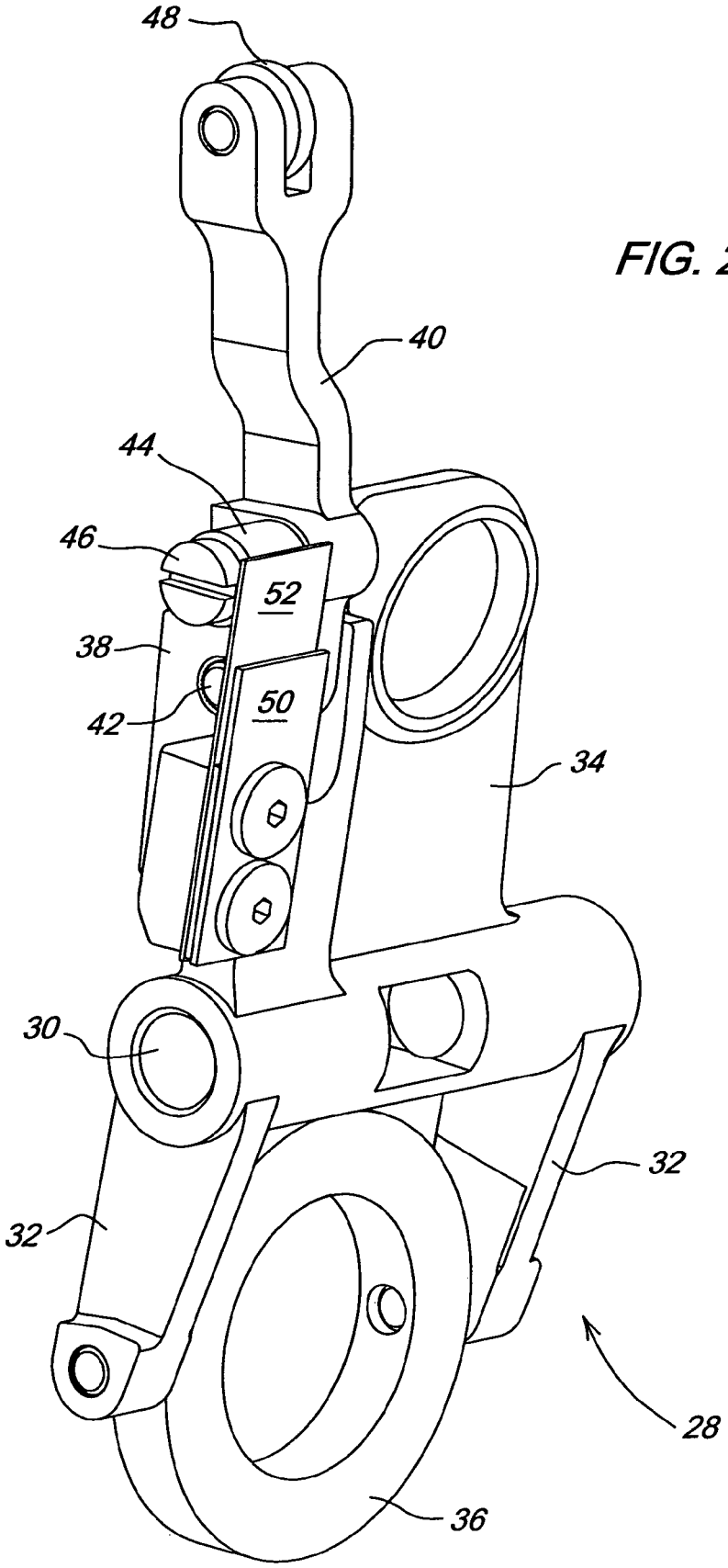
FIG. 2 is a front perspective view of the governor arm assembly according to the invention.
Figure 3:
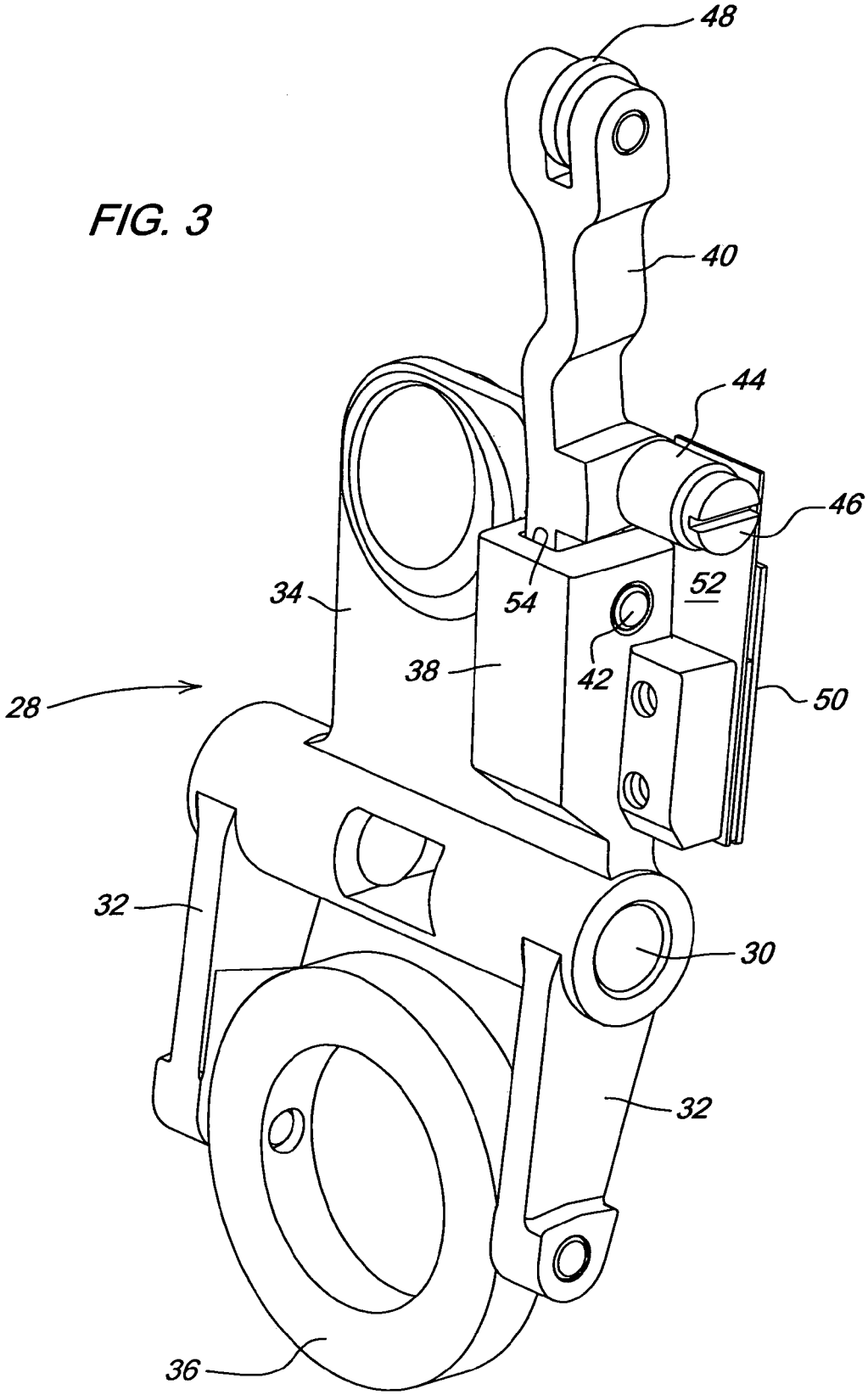
FIG. 3 is a rear perspective of the governor arm assembly of FIG. 2.
Figure 4:
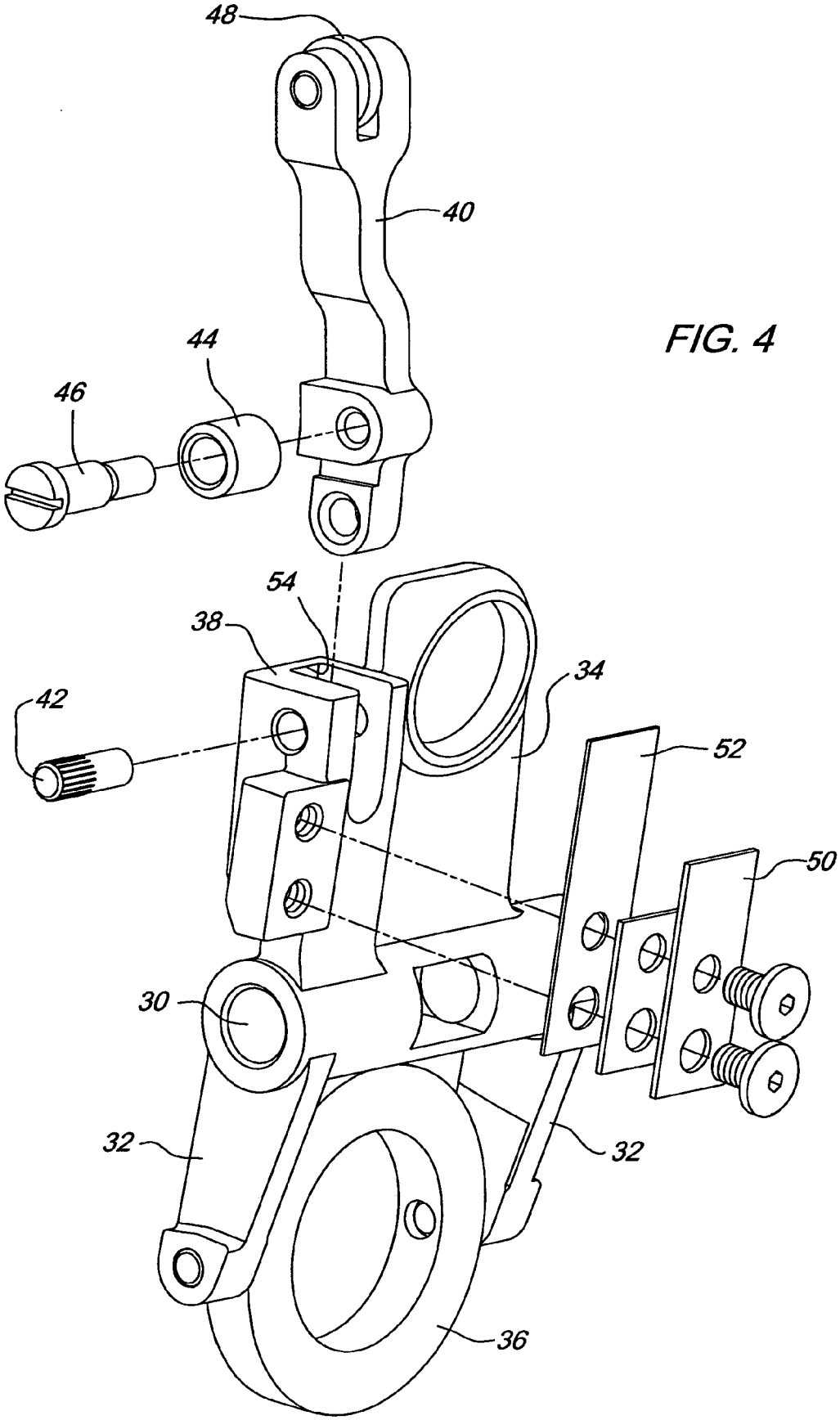
FIG. 4 is an exploded perspective view of the governor arm assembly of FIG. 2.

With reference now to the drawings it can be seen that a governor embodying the invention is designated generally by the numeral 10. In FIG. 1 the governor 10 is illustrated in conjunction with a portion of the fuel system of a diesel engine. As shown individual fuel pumping elements 12, connected with injection nozzles 14, are actuated by cam followers 16 engaging an engine driven cam shaft (not shown). The amount of fuel delivered by each pumping element 12 is regulated by control sleeves 18 operatively linked to a control rack 20. Generally, and as will be described in more detail below the governor 10 controls the translation of the control rack 20 and, in turn, the amount of fuel delivered by each pumping element 12. The governor 10 is centrifugally actuated based upon the speed of an engine driven gear 22. In FIGS. 2–4 a portion of the governor 10 embodying the invention is shown. More particularly, a governor arm assembly 28 is illustrated having a central shaft bore 30, a pair of bearing arms 32 and a main arm 34. As shown a bearing member 36 is pivotally mounted between the bearing arms 32. The main arm 34 includes a pivot arm mounting structure 38. One end of a pivot arm 40 is disposed in the pivot arm mounting structure 38 and pivotally journaled there by way of a pin 42. A tension arm roller 44 is mounted to the pivot arm 40 as shown by way of a screw 46. A rack roller 48 is pinned to the other end of the pivot arm 40. Both rollers 42 and 48 are mounted so that they can rotate freely. A tension arm 50 is attached to the main arm 34 adjacent to the tension arm roller 42. A torque capsule (TC) spring 52 is interposed between the tension arm 50 and the main arm 34. The TC spring 52 is preferably a leaf spring, but those skilled in the art will recognize that other means could be employed in lieu of the leaf spring. Thus while the pivot arm 40 can pivot relative to the main arm 34 its motion is limited in a first direction by a physical stop 54, and in a second direction by the TC spring 52.

Figure 5:
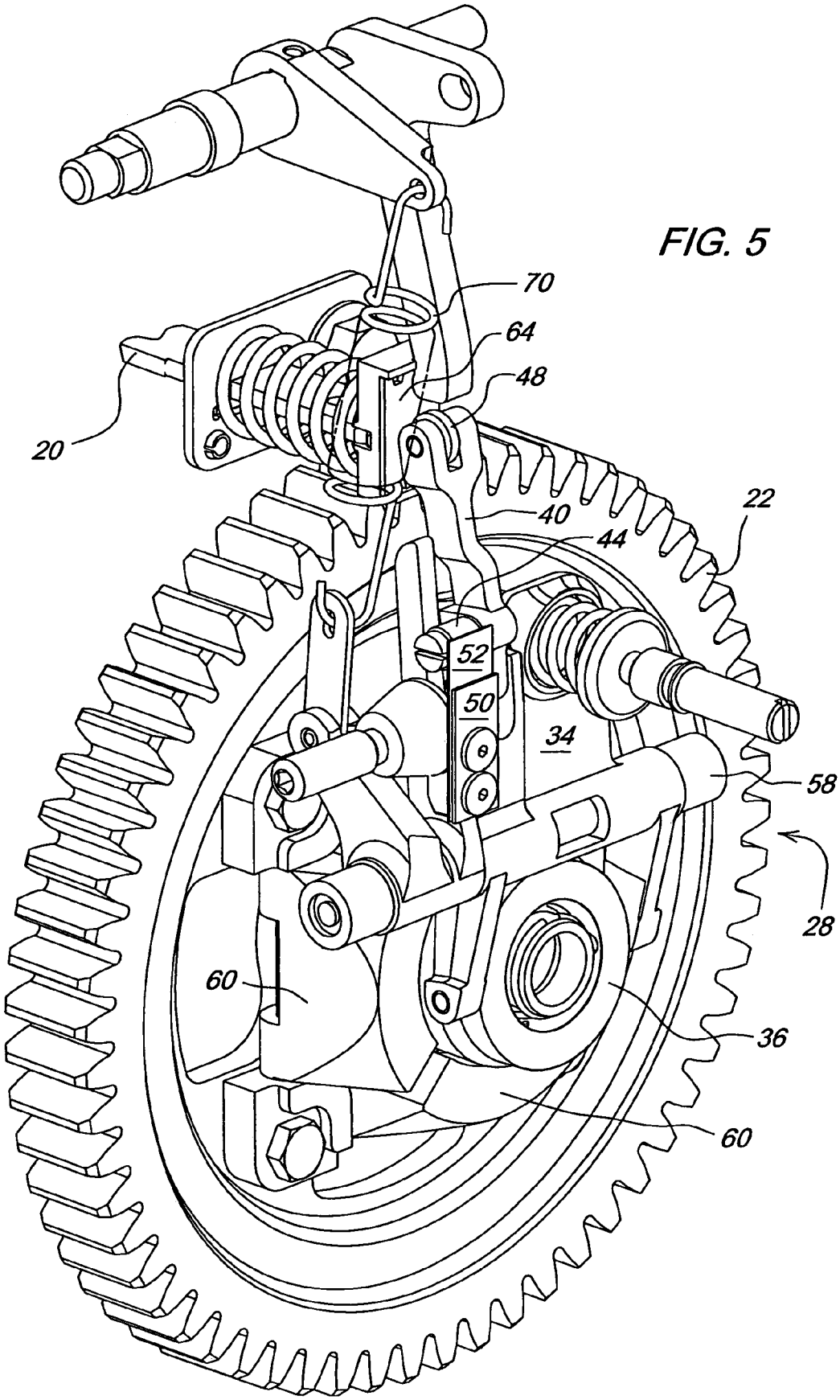
FIG. 5 is a perspective view of a governor embodying the invention.

As shown in FIG. 5 the governor arm assembly 28 is pivotally mounted to the engine by way of a shaft 58 disposed in the shaft bore 30 such that the bearing member 36 is disposed adjacent to a plurality of centrifugal flyweights 60 mounted to the gear 22. As the speed of the gear 22 increases the flyweights 60 are translated in position such that flyweight bearing surfaces bear against the bearing member 36. The governor arm assembly 28 then is forced to pivot on the axis defined by the shaft 58 disposed in the shaft bore. Accordingly, as the bearing member 36 and bearing arms 32 are pushed outward the main arm 34 is pushed inward. The rack roller 48 bears against a rack bearing surface 64 causing translation of the fuel control rack 20.

The TC spring 52 holds the tension arm roller 44 against the tension arm 50. In a static condition the TC spring 52 also holds the pivot arm 40 against the physical stop. As engine speed increases the increased flyweight force causes an increase in the force of the tension arm roller 44 against the tension arm 50. At some point, depending upon the particular preload of the TC spring 52, this force overcomes the preload on the TC spring 52 causing the pivot arm 40 to lift off its physical stop. This effectively causes the governor arm assembly 28 to bend at the joint where the pivot arm 40 is pinned to the main arm 34 causing the rack roller end of the pivot arm 40 to move in a direction of increasing rack travel. As engine speed continues to increase the rack roller 48 continues to increase rack travel until the flyweight force overcomes the main governor spring 70 and rack travel begins to decrease as the engine follows the governor droop curve up to high idle speed.

Figure 6:
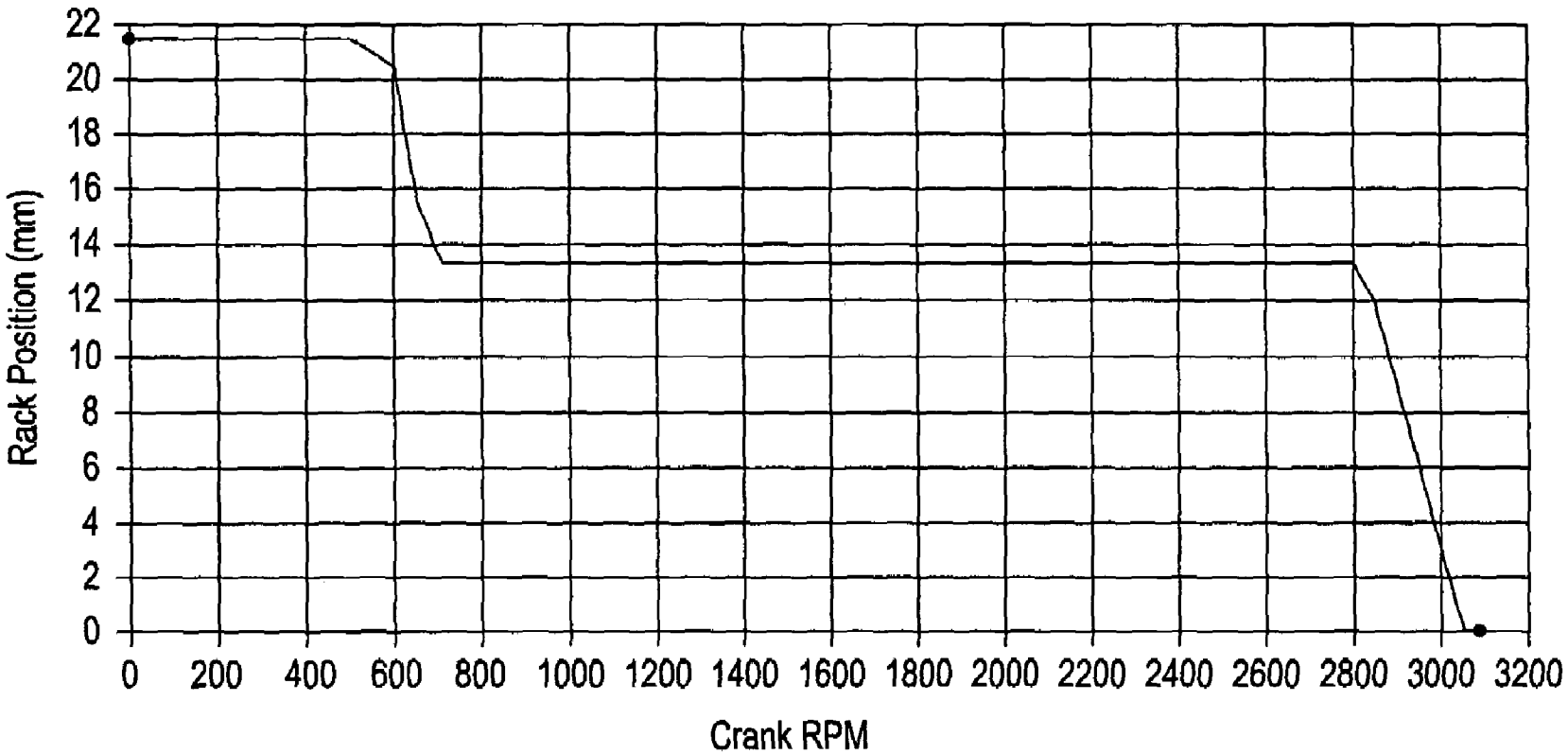
FIG. 6 is a graph wherein rack position is plotted against crank RPM for a known mechanical governor that does not embody the negative rate shaping torque capsule of the present invention; and, FIG. 7 is a graph wherein rack position is plotted against crank RPM for a mechanical governor embodying the negative rate shaping torque capsule of the present invention.

FIG. 6 is a graph wherein rack position is plotted against crank RPM for a known mechanical governor that does not embody the negative rate shaping torque capsule of the present invention. The specific rack position and RPM values stated on both the graph of FIG. 6 and that of FIG. 7, which will be discussed below, are for purposes of illustration only. Those having skill in the art will recognize that the values will vary depending upon a number of variables including engine rating and governor size and characteristics. As can be seen, at 0 RPM the rack position is at approximately 21 mm. As the engine speed increases the flyweights begin to move and at approximately 500 RPM the governor begins to decrease rack travel. As shown, at approximately 700 RPM the rack reaches a position of approximately 13 mm and is maintained at this position until approximately 2800 RPM where the flyweight force overcomes the main spring and rack travel begins to decrease as the engine follows the governor droop curve up to high idle speed.

Figure 7:
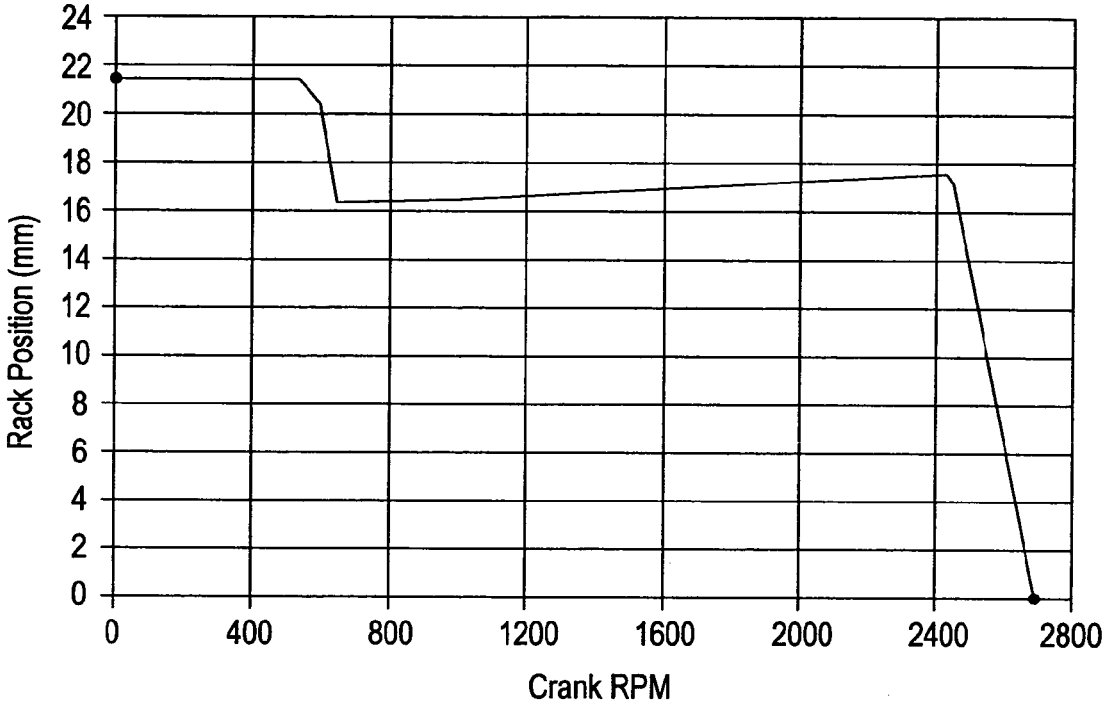

With reference now to FIG. 7, a graph similar to that of FIG. 6 is presented for a mechanical governor using a negative rate shaping torque capsule according to the invention. As shown, at 0 RPM the rack position is again at approximately 21 mm. As the engine speed increases the flyweights begin to move and at approximately 500 RPM the governor begins to decrease rack travel. At approximately 700 RPM the rack reaches a position of approximately 16 mm. However, here, instead of maintaining rack position constant until the droop curve begins, the torque capsule of the invention allows for a certain degree of increased rack travel from approximately 16 mm at 700 RPM to about 18 mm at 2400 RPM. Like the standard governor discussed above with respect to FIG. 5 once the engine speed increases enough to allow the flyweights to overcome the main spring, rack travel begins to decrease further as the engine follows the governor droop curve to high idle speed. Because the rack position is allowed to increase somewhat with increased engine speed, and decrease somewhat with decreased engine speed, the amount of fuel backup is decreased, thereby preventing excess torque rise and reducing smoke and exhaust emissions Thus it can be seen that the objects of the invention have been satisfied by the structure presented above. While in accordance with the patent statutes, only the best mode and preferred embodiment of the invention has been presented and described in detail, it is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly and legally entitled.

The embodiments of the invention in which an exclusive property or privilege is claimed are defined as follows:

1. A governor for an internal combustion engine, the governor being operative to translate a fuel control rack of the engine in response to centrifugally actuated flyweight movement in response to engine speed, the governor comprising:

a governor arm body;

a pivot arm pivotally mounted to the governor arm body;

a tension arm attached to the governor arm body adjacent to the tension arm roller; and, a torque capsule (TC) spring interposed between the tension arm and the governor arm body so that the pivot arm can pivot relative to the governor arm body;

wherein the TC spring holds the pivot arm against the tension arm and as engine speed increases, a flyweight force causes an increase in the force of the pivot arm against the tension arm, as speed increases further, the flyweight force overcomes a preload of the TC spring causing the pivot arm to pivot at a joint where the pivot arm is mounted to the governor arm body, in turn causing an end of the pivot arm to move in a direction of increasing rack travel and as engine speed continues to increase, the pivot arm continues to increase rack travel until the flyweight force overcomes a main governor spring, so that rack position is allowed to increase with increased engine speed, and decrease with decreased engine speed, thereby reducing the amount of fuel backup and preventing excess torque rise and reducing smoke and exhaust emissions.

2. A governor for an internal combustion engine according to claim 1 wherein the governor arm body has a central shaft bore, a pair of bearing arms and a main arm.

3. A governor for an internal combustion engine according to claim 2 wherein a bearing member is pivotally mounted between the bearing arms.

4. A governor for an internal combustion engine according to claim 2 wherein the main arm includes a pivot arm mounting structure.

5. A governor for an internal combustion engine according to claim 4 wherein a first end of the pivot arm is disposed in the pivot arm mounting structure and pivotally journaled there by way of a pin.

6. A governor for an internal combustion engine according to claim 5 wherein the tension arm roller is mounted to the pivot arm by way of a screw.

7. A governor for an internal combustion engine according to claim 4 wherein the rack roller is pinned to a second end of the pivot arm.

8. A governor for an internal combustion engine according to claim 2 wherein the pivot arm is able to pivot relative to the main arm and its motion is limited in a first direction by a physical stop, and in a second direction by the TC spring.

9. A governor for an internal combustion engine according to claim 1 wherein the TC spring is a leaf spring.

10. A governor for a compression ignition engine, the engine having a fuel system wherein individual fuel pumping elements, connected with injection nozzles, are actuated by cam followers engaging an engine driven cam shaft and the amount of fuel delivered by each pumping element is regulated by control sleeves operatively linked to a control rack, the governor is centrifugally actuated based upon the speed of an engine driven gear and controls the translation of the control rack and, in turn, the amount of fuel delivered by each pumping element, the governor comprising:

a governor arm body having a central shaft bore, a pair of bearing arms and a main arm, the main arm having a mounting structure;

a bearing member pivotally mounted between the bearing arms;

a pivot arm having a first end and a second end, the first end being disposed in the mounting structure and pivotally journaled there, a portion of the mounting structure serving as a physical stop for the pivot arm;

a tension arm roller mounted to the pivot arm;

a rack roller mounted to the second end of the pivot arm;

a tension arm attached to the main arm adjacent to the tension arm roller; and, a torque capsule (TC) spring interposed between the tension arm and the main arm so that the pivot arm can pivot relative to the main arm, but its motion is limited in a first direction by the physical stop, and in a second direction by the TC spring;

wherein the TC spring holds the tension arm roller against the tension arm and in a static condition holds the pivot arm against the physical stop, as engine speed increases increased flyweight force causes an increase in the force of the tension arm roller against the tension arm, as speed increases further the flyweight force overcomes a preload of the TC spring causing the pivot arm to lift off its physical stop, in turn causing the governor arm assembly to bend at a joint where the pivot arm is mounted to the main arm, in turn causing the rack roller end of the pivot arm to move in a direction of increasing rack travel and as engine speed continues to increase, the rack roller continues to increase rack travel until the flyweight force overcomes a main governor spring, so that rack position is allowed to increase with increased engine speed, and decrease with decreased engine speed, thereby reducing the amount of fuel backup and preventing excess torque rise and reducing smoke and exhaust emissions.

11. A governor for a compression ignition engine according to claim 10 wherein the TC spring is a leaf spring.

* * * * *